United States Patent [19]

Stojanowski

[11] Patent Number: 4,825,731

[45] Date of Patent: May 2, 1989

[54] RATCHETING OPEN END WRENCH

[76] Inventor: Thomas Stojanowski, 97 Delafield Pl., Staten Island, N.Y. 10310

[21] Appl. No.: 169,022

[22] Filed: Mar. 16, 1988

[51] Int. Cl.[4] ..... B25B 13/28

[52] U.S. Cl. ..... 81/111

[58] Field of Search ..... 81/98, 99, 111

[56] References Cited

U.S. PATENT DOCUMENTS 1,015,504 1/1912 Meyer ..... 81/111

3,039,949 3/1967 Neff ..... 81/111

4,276,790 7/1981 Davis ..... 81/111

4,554,847 11/1985 Desantis ..... 81/111

4,584,913 4/1986 Logan ..... 81/111 X

*Primary Examiner*—Debra Meislin

*Attorney, Agent, or Firm*—Richard L. Miller

[57] ABSTRACT

A ratcheting open end wrench is designed to be employed in close places to remove nuts and bolts. Primarily, it consists of a handle having a fixed jaw and a pivotal jaw, and the pivotal jaw is provided with an attached arm with a spur that engages with a lip of the handle to prevent over travel of the pivotal jaw.

3 Claims, 1 Drawing Sheet

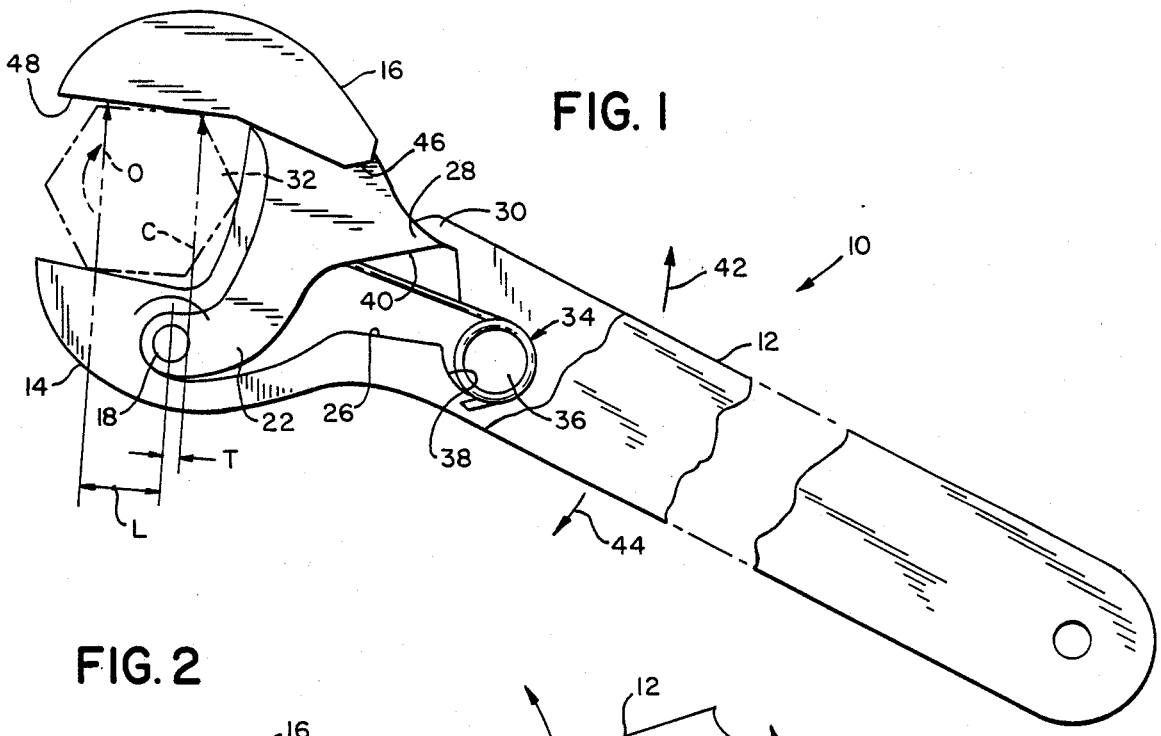
FIG. 1
FIG. 2
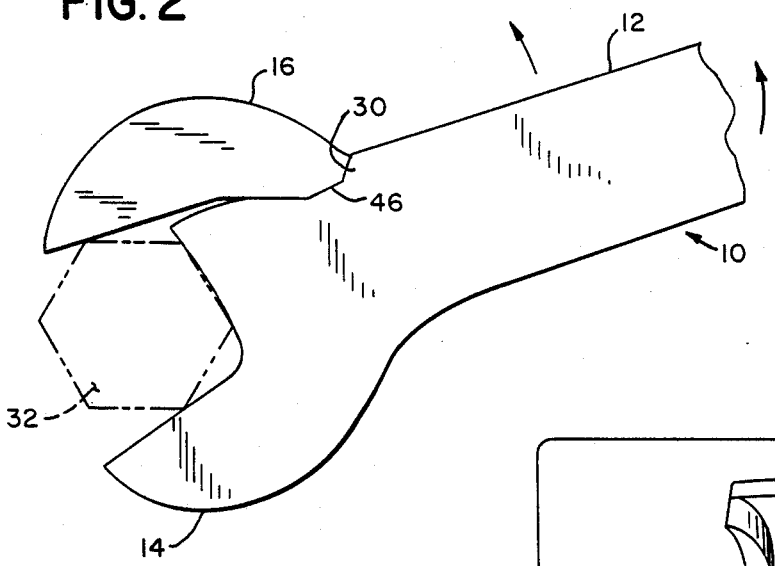
FIG. 3
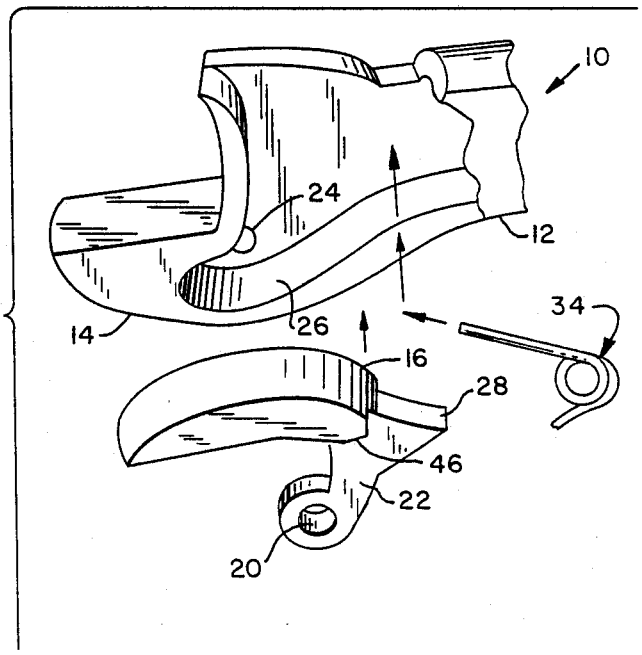

RATCHETING OPEN END WRENCH

BACKGROUND OF THE INVENTION

The instant invention relates generally to hand tools, and more particularly, to a ratcheting open end wrench.

Numerous wrenches have been provided in the prior art that are adapted to facilitate easier removal of nut and bolt fasteners. For example, U.S. Pats. Nos. 4,584,913 of Logan, 4,554,847 of DeSantis, and 3,309,949 of Neff, all are illustrative of such prior art. While these units may be suitable for the particular purpose to which they address, they would not be as suitable for the purpose of the present invention as hereafter described.

SUMMARY OF THE INVENTION

A primary object of the present invention is to provide a ratcheting open end wrench that will overcome the shortcomings of the prior art devices.

Another object is to provide a ratcheting open end wrench that will be of such design, as to provide for fast removal of nut and bolt fasteners in limited spaces.

An additional object is to provide a ratcheting open end wrench that may be employed where one can't employ a ratchet box or ratchet socket, and removal will be at least four times faster than now possible.

A further object is to provide a ratcheting open end wrench that is simple and easy to use.

A still further object is to provide a ratcheting open end wrench that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a side elevational view of the instant invention, shown partly broken away and rotating a fastener illustrated in phantom;

FIG. 2 is a fragmentary side view, showing the release position of the jaw of the invention; and FIG. 3 is a diagrammatic fragmentary exploded perspective view of the invention.

DETAILED DESCRIPTION OF THE PREFERRED EMBODIMENTS

Turning now descriptively to the drawings, in which like reference characters denote like elements throughout the several views, a wrench 10 is shown to include a handle 12 having a fixed jaw 14 integrally attached to its front end, and a pivotal jaw 16 is rotatively mounted by a pin 18 received in opening 20 of arm 22 and opening 24 through fixed jaw 14. Pivotal jaw 16 is freely received within a cavity 26 and a spur 28 integrally attached to a rear portion of arm 22, engages with a lip 30 that is integrally attached to a projecting forward end of handle 12. Lip 30 serves as a stop and limits pivotal rotation of pivotal jaw 16, which is urged in a pivotal action against nut fastener 32 by the inherent biasing action of spring 34 that is mounted on a projecting pin 36 fixedly secured to one side of handle 12 within the cavity 26.

One end of spring 34 is held within an opening 38 in handle 12 and the other end of spring 34 is engaged under the bottom side 40 of spur 20.

Looking now particularly at FIG. 1, it will be seen that when the wrench 10 is pivoted in the direction of the arrow 44, jaw 16 locks on the fastener 32, holding it securely and rotating it in a clock-wise direction, and when wrench 10 is rotated in the direction indicated by arrow 42, the jaw 16 pivots away and releases fastener 32, enabling wrench 10 to pivot around the fastener 32 while fastener 32 remains stationary. When wrench 10 is turned sufficiently, the pivotal jaw 16 will snap back into its normal position, enabling fastener 32 to be again rotated.

It shall be noted that the faces of the jaws 14 and 16 are not cut parallel. The pivotal jaw 16 is cut at an angle and includes an end portion 46, and further, the spur 28 abuts with lip 30, thus preventing stress being put upon the pivot fastener 18 when wrench 10 is being used.

It is to be even further recognized that the positioning of the surface 48 of jaw 16 is at a few degrees with respect to the opposing jaw 14 is crucial to the entire operation of the ratcheting mechanism of the instant invention. This is because when the wrench is rotated clock-wise as illustrated by arrow 44 in FIG. 1 force vector C is to the right of pivot pin's center 18 by the distance T which cause the jaw 16 to close and tighten its grasp on nut 32, while conversely when the wrench is rotated counter clockwise as shown by arrow 42 in FIG. 1 force vector 0 is to the left of pivot pin's center 18 by the distance L which cause the jaw 16 to open and loosen it's grasp on nut 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ratcheting open end wrench, comprising a handle, a fixed jaw secured to said handle, a pivotal jaw secured in said handle, and a spring secured in said handle, said spring providing biasing means for pivoting said pivotal jaw to engage with a nut fastener in cooperation with said fixed jaw and allowing for ratcheting nongripping rotation of said wrench in one direction and non-ratcheting gripping rotation of said wrench in an opposite direction with respect to and during engagement with a nut fastener, wherein said pivotal jaw includes an arm pivotally secured to the fixed jaw by a pivot pin, and said arm is freely received in a recess provided in said fixed jaw and said handle, each of said fixed and pivotal jaw having opposed straight edged gripping faces for engaging opposed parallel sides of the nut fastener, means responsive to the non-ratcheting gripping rotation of said wrench to force said pivotal jaw toward said fixed jaw, said means including the gripping face of said pivotal jaw being angularly relative disposed to the gripping face of said fixed jaw during the non-ratcheting gripping rotation of said wrench.

2. A ratcheting open end wrench as set forth in claim 1, wherein said arm is integrally attached to said pivotal jaw and a spur means is fixedly secured to said arm and extends rearward in said handle and engages with an underside of a lip integrally attached to a forward portion of said handle, and said lip acts as stop means against preventing too far a pivotal travel of said pivotal jaw and prevents stress from being placed on said pivot fastener when said pivotal jaw is pivoted forward.

3. A ratcheting open end wrench as set forth in claim 2, wherein said spur means includes a spur, and said spring includes one end that biasedly engages with an underside of said spur and another end of said spring is held in an opening provided in said handle, and said spring is received and mounted upon a second pin fixedly secured to said handle.

* * * * *